US007866484B2

(12) United States Patent
Jaukkuri

(10) Patent No.: US 7,866,484 B2
(45) Date of Patent: Jan. 11, 2011

(54) SORTING DEVICE AND METHOD

(75) Inventor: Tuomo Jaukkuri, Rantasalmi (FI)

(73) Assignee: Rantasalmen Scel Oy, Rantasalmi (FI)

( * ) Notice: Subject to any disclaimer, the term of this patent is extended or adjusted under 35 U.S.C. 154(b) by 636 days.

(21) Appl. No.: 10/572,339

(22) PCT Filed: Sep. 17, 2004

(86) PCT No.: PCT/FI2004/000546

§ 371 (c)(1),
(2), (4) Date: Feb. 21, 2008

(87) PCT Pub. No.: WO2005/025762

PCT Pub. Date: Mar. 24, 2005

(65) Prior Publication Data

US 2008/0128337 A1 Jun. 5, 2008

(30) Foreign Application Priority Data

Sep. 17, 2003 (FI) ..... 20031330

(51) Int. Cl.
*B07C 5/00* (2006.01)

(52) U.S. Cl. ..... 209/643; 209/432; 209/433; 209/480; 209/488; 209/507

(58) Field of Classification Search ..... 209/432, 209/433, 480, 481, 488, 507, 643
See application file for complete search history.

(56) References Cited

U.S. PATENT DOCUMENTS 1,491,211 A * 4/1924 Taylor ..... 209/269
3,108,950 A * 10/1963 Buckley ..... 209/466
3,744,632 A * 7/1973 Mozley ..... 209/433
3,757,946 A * 9/1973 Berkowitz et al. ..... 209/639
4,260,482 A * 4/1981 D'Aragon ..... 209/480
4,293,408 A * 10/1981 Herder ..... 209/638
4,426,005 A * 1/1984 Satake ..... 209/581
5,245,188 A * 9/1993 Satake et al. ..... 250/341.7

FOREIGN PATENT DOCUMENTS

EP 1 013 348 A1 6/2000
GB 2 294 757 A 5/1996
WO WO 02/41967 5/2002

* cited by examiner

*Primary Examiner*—Stefanos Karmis
*Assistant Examiner*—Terrell H Matthews
(74) *Attorney, Agent, or Firm*—Merchant & Gould P.C.

(57) ABSTRACT

The invention relates to a sorting device and method for sorting granulated mass containing varied materials, such as granulated mass containing varied materials, such as granulated electronic scrap. According to the invention, the sorting device comprises a planar, elongated trough conveyor (1) having at least a first elongated and vertical edge (2, 3, 4); a feeding device (5) for feeding the mass into the first end (6) of the trough conveyor; a vibrator (9) provided with a motor (7) and an eccentric (8), whose rotation axis (10) is disposed in a plane deviating from the plane defined by the trough conveyor so that the mass proceeds obliquely forwards in the trough conveyor towards the first edge and second end (11); a first suction device (12) for removing the lightest surface portion of the mass near the edge, a guide (13) which is oblique with respect to the edge for bringing apart the mass flow from the edge; as well as a mechanical separator member (14) for dividing the mass flow into two parts.

14 Claims, 3 Drawing Sheets

SORTING DEVICE AND METHOD

FIELD OF THE INVENTION

Figure 1:
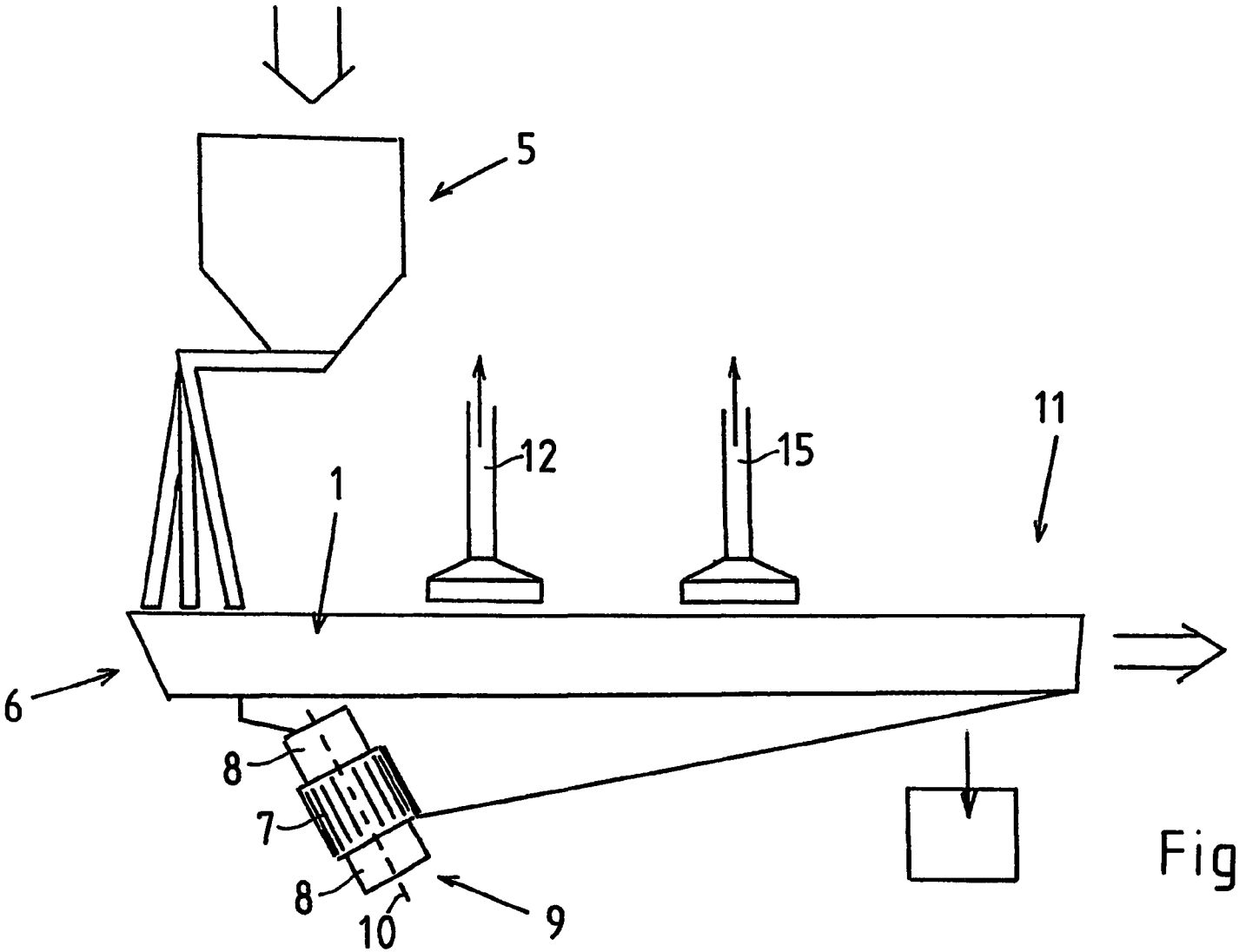

The invention relates to a sorting device as defined in the preamble of claim 1 and a sorting method as defined in the preamble of claim 10 for sorting specifically crushed electronic scrap.

BACKGROUND OF THE INVENTION

At present, varied electronic scrap, such as used electric appliances such as computers, printers, copying machines, televisions, radios, videos, telephones, cables, is produced in more and more increasing numbers. This scrap consists of various different materials, such as plastic, wood, glass and different metals, e.g. iron, copper, aluminium, silver and gold. Electronic scrap of this kind is nowadays recovered and cannot be brought to public dumping places. Usually, the devices are manually disassembled into smaller parts, i.e. a more massive sorting is done with respect to bigger parts, i.e. metal boxes, wood barks, image tubes, etc. are sorted separately. The rest of the material is crushed for each device and material specifically into a granular form, the granular size varying e.g. between 1-20 mm.

The problem with the prior art is first of all the sorting of the crushed scrap. How to separate different materials from one another as accurately as possible so that the resultant raw materials would be pure and easily reusable.

OBJECTIVE OF THE INVENTION

The objective of the invention is to eliminate the drawbacks referred to above. One specific objective of the invention is to disclose a new kind of sorting device that enables accurate sorting of different materials from one another from granulated electronic scrap.

SUMMARY OF THE INVENTION

The sorting device in accordance with the invention is characterised by what has been presented in claim 1, and the sorting method in accordance with the invention is characterised by what has been presented in claim 10.

The sorting device in accordance with the invention is designated for sorting e.g. granulated mass containing varied materials, such as granulated electronic scrap. According to the invention, the sorting device comprises a planar, elongated trough conveyor having at least one first elongated and vertical edge. In addition, the trough conveyor is substantially horizontal. Similarly, the device comprises a feeding device for feeding mass into the first end of the trough conveyor, as well as a vibrator provided with a motor and an eccentric, whose rotation axis is disposed in a plane deviating from the horizontal plane defined by the trough conveyor so that by the effect of the vibration, the mass proceeds obliquely forwards in the trough conveyor towards the first edge and second end of the trough conveyor. Further, the device comprises a first suction device for removing the lightest surface portion of the mass accumulated in layers near the edge, a guide that is oblique with respect to the edge for bringing apart the mass flow from the edge, as well as a mechanical separator member for dividing the mass flow into two parts. The purpose of the oblique guide is to further turn the mass flow so as to be even more transverse than the edge of the trough conveyor with respect to the actual conveying direction of the mass of the vibrator. In that case, the rotation of the mass and the separation due to it are enhanced even more against the oblique guide.

Advantageously, the rotation axis of the vibrator is disposed in the longitudinal plane of the trough conveyor, which is perpendicular to the plane defined by the trough conveyor. Thus, when using just one rotating eccentric, the trough conveyor is subjected not just to a longitudinal power component that conveys the mass but to a transverse power component that conveys the mass towards the first edge of the trough conveyor. These power components together convey the mass obliquely forward, achieving a rotating propagating motion of the mass against the edge. The rotation axis can be e.g. at an angle of 30 degrees from the perpendicular direction.

Advantageously, the sorting device comprises a second suction device in the area of the oblique guide for removing the lighter portion that was separated on top of the mass. The second suction device can be disposed right in the beginning of the oblique guide or farther ahead along its length. On the other hand, the place of the suction device can be adjustable according to the separation ability of the mass each time being processed, or there can be in the device even more than one suction device, which are used suitably and optionally according to need.

Advantageously, the oblique guide is formed by a solid wall, i.e. in practice an edge of the trough conveyor that turns into the centre, the edge preventing straightforward movement of the mass in the longitudinal direction of the trough conveyor.

In one embodiment of the invention, the mechanical separator member, which is used to separate from the moving mass preferably the heaviest fraction, is a wall that directs the heaviest portion of the mass from the direct vicinity of the oblique guide so as to be separate from the rest of the mass. The mechanical separator member can also be an aperture in the trough conveyor that directs the heaviest portion of the mass from the direct vicinity of the oblique guide so as to be separate from the rest of the mass below the plane of the trough conveyor.

It is also possible that the mechanical separator member includes an adjustment, the adjustment of the wall's place or position or the adjustment of the size of the aperture, in order to adjust the relative amount of the mass being separated from the total mass.

In one embodiment of the invention, although the trough conveyor is mainly substantially horizontal, it is arranged to be uphill at its first end towards the first edge in the propagation direction of the mass. This is used to slow down the propagation of the mass especially on the surface of the mass layer, whereby the heavier mass fractions propagate faster near the surface of the trough conveyor and the lighter ones more slowly on the mass surface.

In the sorting method in accordance with the invention for sorting granulated mass containing various materials, such as granulated electronic scrap, the mass is conveyed along a planar, elongated trough conveyor in an oblique direction with respect to its longitudinal direction towards its second edge using vibration so that the mass is brought into a movement rotating against the edge and propagating along the trough conveyor; and during the rotating and propagating movement of the mass, the light mass particles accumulated on the surface thereof are removed using suction, and the heaviest particles of the propagating mass are mechanically separated from the mass flow.

Advantageously, suction is used at least in two different phases during the rotating and propagating movement of the mass.

The method in accordance with the invention can be performed one or more times for a mass that was left from the first sorting phase, from which mass the lightest and heaviest particle size has been removed.

In one embodiment of the invention, the method is implemented at least as two, preferably as three parallel and identical sorting processes, the unseparated masses obtained from which are combined and directed to another similar common sorting process. The number of the parallel sorting processes can be freely selected in a manner required by the mass flows.

In one embodiment of the invention, arranged in the trough conveyor is an inclining device that enables inclining the entire trough conveyor or a part thereof in the crosswise or possibly also in the longitudinal direction of the trough conveyor. Hence, the inclining can also be used to slow down the movement of the mass in the crosswise and longitudinal direction towards the first edge, whereby especially the lighter material on the surface of the mass propagates more slowly and is more clearly distinguished from the rest of the mass.

The sorting device and sorting method in accordance with the invention have significant advantages over prior art. They can be used to fast and efficiently process big amounts of granulated material and to separate from them materials that are various in terms of their specific weight.

LIST OF FIGURES

Figure 2:
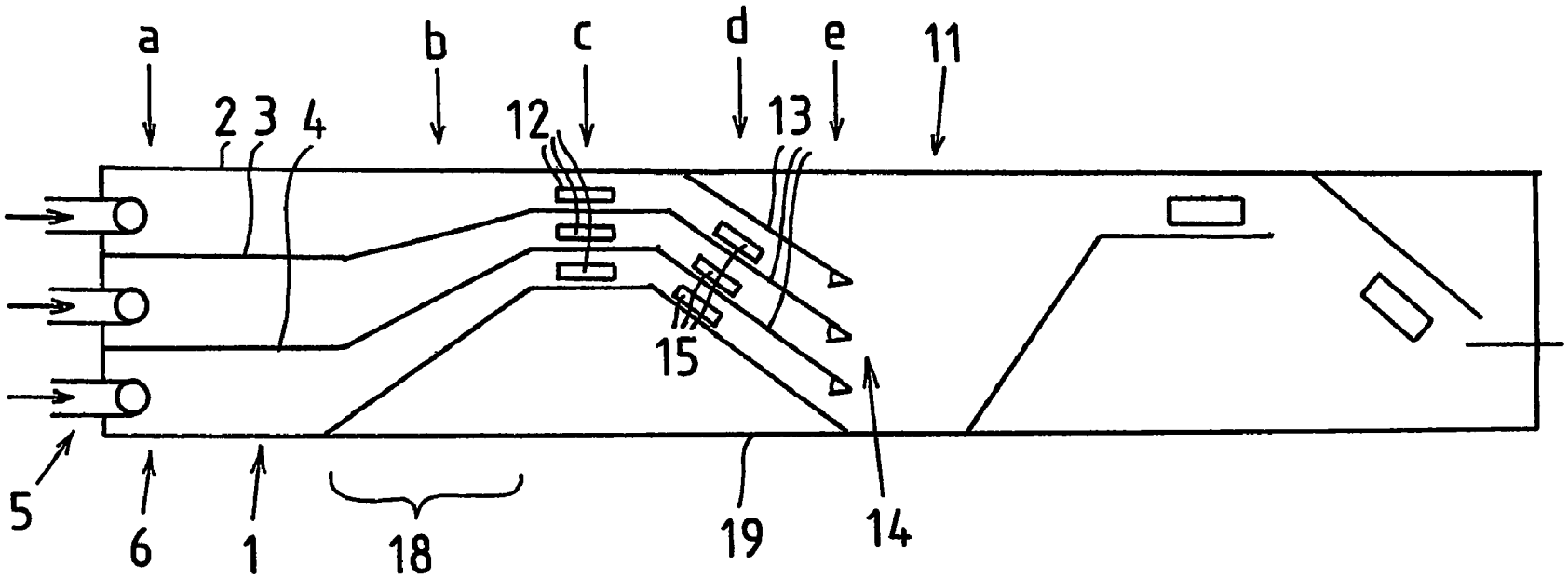
Figure 3:
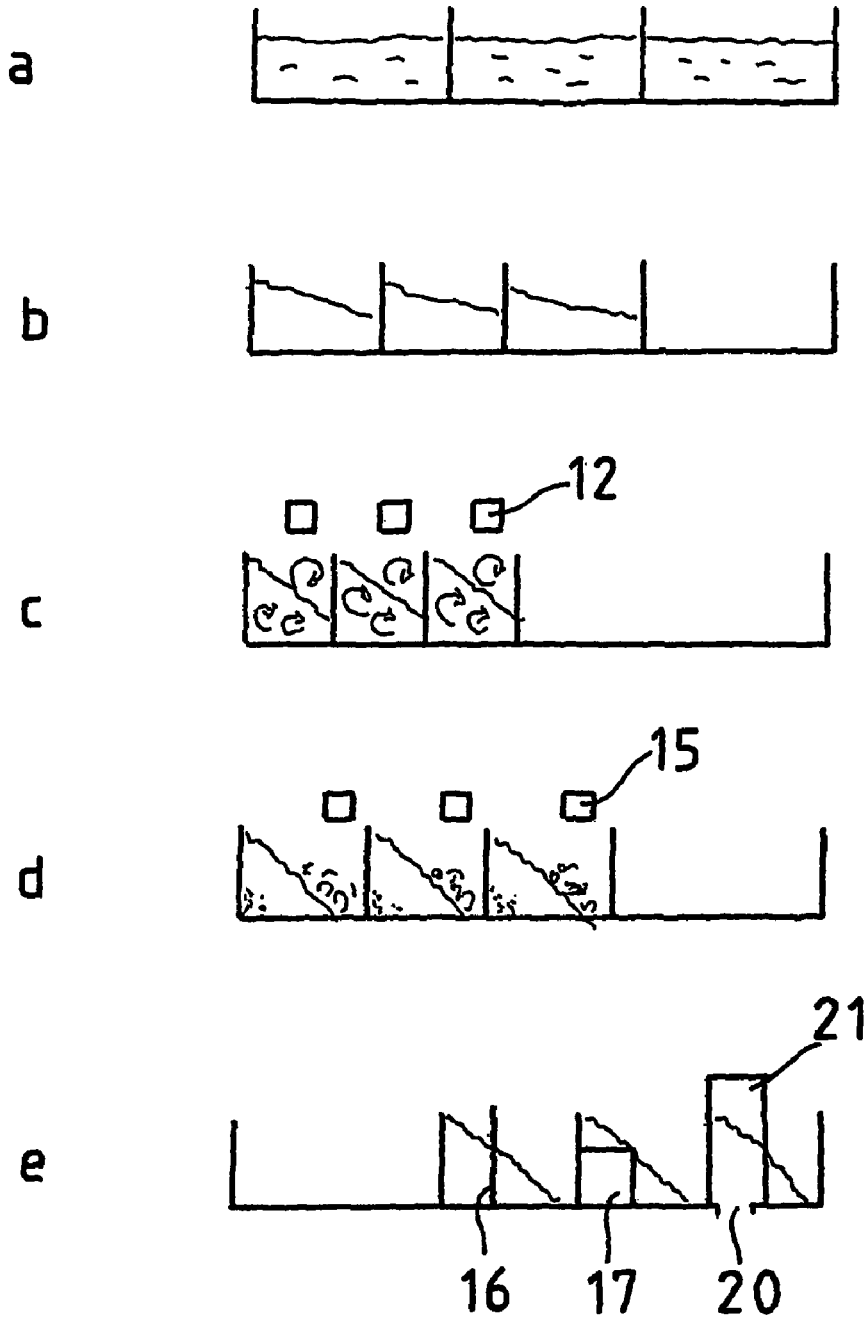

In the following section, the invention will be described in detail by means of examples with reference to the accompanying drawing, wherein FIG. 1 schematically represents one sorting device in accordance with the invention as seen from the side;

FIG. 2 schematically represents the device as shown in FIG. 1 as seen from the top; and FIG. 3 represents five different cross sections of the mass flows in FIG. 2.

DETAILED DESCRIPTION OF THE INVENTION

The drawings show one sorting device in accordance with the invention which is specifically designed for sorting crushed electronic scrap. The equipment includes a substantially horizontal and flat-bottomed trough conveyor 1, outside which on the bottom there is attached a vibrator 9 containing an electronic motor 7 and eccentrics 8 so that the rotation axis 10 of the vibrator is disposed in the vertical plane, which is parallel to the longitudinal direction of the trough conveyor and perpendicular to the plane of the trough conveyor, and furthermore turned to an angle of about 30 degrees from the lower end of the shaft 10 onward from the vertical plane. In this way, the vibration motion of the eccentrics can be directed to the mass on top of the trough conveyor as desired.

In the vicinity of the first end 6 of the trough conveyor 1 there is a feeding device 5 for feeding the mass to be processed on top of the trough conveyor. On top of the trough conveyor 1 there are three vertical edges and three edges 2, 3, 4 that are in parallel to the longitudinal direction of the trough conveyor, which divide the trough conveyor into three equally wide sub-troughs in its lateral direction.

While propagating forwards in the trough conveyor, the sub-troughs are narrowed and directed so as to propagate obliquely towards the first edge 2. At the same time, in this narrowing section, the bottom of the trough conveyor is arranged to be evenly uphill towards the edge 2. After the narrowing section 18, the sub-troughs are disposed side by side, and are narrow and equally wide next to the edge 2, and parallel to the longitudinal direction of the trough conveyor. Arranged in this narrow section on top of the sub-troughs are first suction devices 12 separately for each sub-trough.

The suction devices to be used in the invention represent a technique known per se and comprise suitable nozzles, suction pipes, separators and a vacuum source, so their structure is not discussed more fully herein.

After the first suction devices 12, the sub-troughs turn obliquely towards the second end 19 of the trough conveyor, while at the same time increasing in width. Placed in this broadening zone are second suction devices 15 separately for each sub-trough, in the vicinity of the surface of the mass that propagates in them. The end of the broadening zone includes mechanical separator members 14, after which the remaining three mass flows are combined and directed to a common sorting device that contains the different components and functions corresponding to the aforesaid description in the same order.

The equipment in accordance with the invention and shown in the drawings functions as follows. A feeding device 5 is used to direct to the first end 6 of the trough conveyor 1 a suitable mass flow of crushed electronic scrap, while at the same time using a vibrator 9. The crushed aggregate containing fractions of various sizes and weights is first uniformly spread in between the edges 2, 3, 4 and 19, as shown in FIG. 3*a*.

By the effect of the directed vibration, the mass starts to move forward in the trough conveyor and in the direction of motion, obliquely to the left towards the narrowing area 18. There starts to be more separation in the narrowing area 18, which is due to the transverse rotating motion component, the narrowing of the track and the gentle slope in the track. In this manner, the heavier particles nearer the surf ace of the trough propagate more slowly. At the same time, the masses as shown in FIG. 3*b* pack obliquely against the left edge of the troughs.

As the mass, after the narrowing area 18, reaches the narrowest area of the sub-troughs, as shown in FIG. 3*c*, the surfaces of the masses are relatively sharply askew towards the left edge. In that case, the masses are brought into a powerful rotating transverse movement, which is due to the transverse rotating power component of the vibrator. However, the rotating movement is not performed uniformly in the entire mass, but separately for the sub-masses. The heaviest mass rotates lowermost near the edge and the lightest mass rotates on the surface of the oblique mass and finally to the right lower end of the mass flow in the main direction of motion, i.e. in the longitudinal direction of the trough conveyor. Placed in this area are the first suction devices 12, which are used to remove the lightest mass.

After the first suction, the guides 13 turn the sub-troughs to the right, i.e. towards the second end of the trough conveyor 19, while at the same time widening them. As the path of motion of the mass is more at an angle against the vibrator's resultant force conveying the mass, the mass flow gets slower, the rotating accelerates and the mass is brought more than before into an oblique position against the guide walls 13, as shown in FIG. 3*d*. Placed in this area are the second suction devices 15 suitably close to the lower edges of the oblique mass surfaces to suck the remaining lighter particles.

After the second suction, as the mass keeps propagating, separation is performed all the time, and at the end of the trough conveyors, mechanical separator members 14 are used to separate the heaviest mass that proceeded beneath, along the left edge. As can be seen from FIG. 3*e*, the separator member can be a vertical wall 16 that cuts the mass flow into two parts in the vertical direction, or it can be a vertical hole or an aperture 17 that separates a certain flow cross section inside the mass flow, or it can be an aperture 20 on the bottom, into which the mass is directed using a suitable plate 21.

After the separator members 14, the remaining mass flows are combined, and the mass obtained is processed on one of the aforementioned lines instead of three similar adjacent ones. As the heaviest and lightest fractions, i.e. the ones easiest to sort, have already been separated from this kind of mass, it is obvious that there is a reason to change and adjust the dimensions of the trough conveyors, the places and suction powers of the suction devices, as well as the structure and sizes of the separator members compared to the rules of the sorting of the first phase.

The invention is not limited merely to the examples referred to above, instead many variations are possible within the scope of the inventive idea defined by the claims.

The invention claimed is:

1. A sorting device for sorting granulated mass containing varied materials, wherein the sorting device comprises a planar, elongated trough conveyor having at least a first elongated and vertical edge; a feeding device for feeding mass into the first end of the trough conveyor; a vibrator provided with a motor and an eccentric, whose rotation axis is disposed in a plane deviating from the plane defined by the trough conveyor so that the mass proceeds obliquely forwards in the trough conveyor towards the first edge and second end; a first suction device for removing the lightest surface portion of the mass near the edge; a guide which is oblique with respect to the edge for bringing apart the mass flow from the edge; and a mechanical separator member for dividing the mass flow into two parts, wherein the mechanical separator includes a wall which directs the heaviest portion of the mass from the direct vicinity of the oblique guide so as to be separate from the rest of the mass, and the mechanical separator includes an adjustment for adjusting the relative amount of the mass to be separated.

2. The sorting device as defined in claim 1, wherein the rotation axis of the vibrator is in the longitudinal plane of the trough conveyor, which is perpendicular to the plane defined by the trough conveyor.

3. The sorting device as defined in claim 2, wherein the rotation axis is at angle of about 30 degrees from the perpendicular direction.

4. The sorting device as defined in claim 1, wherein the sorting device comprises a second suction device in the area of the oblique guide for removing the lighter portion being separated on top of the mass.

5. The sorting device as defined in claim 1, wherein the oblique guide is formed by a solid wall which prevents straightforward movement of the mass in the longitudinal direction of the trough conveyor.

6. The sorting device as defined in claim 1, wherein the mechanical separator member is an aperture which directs the heaviest portion of the mass from the direct vicinity of the oblique guide so as to be separate from the rest of the mass.

7. The sorting device as defined in claim 1, wherein the trough conveyor is uphill from its first end towards the first edge in the propagation direction of the mass.

8. A sorting method for sorting granulated mass containing varied materials, the method comprising: conveying granulated mass containing varied materials along a planar, elongated trough conveyor in an oblique direction with respect to its longitudinal direction towards its second edge using vibration so that the mass is brought into a motion rotating against the edge and propagating along the trough conveyor; removing light particles from the surface of the mass using suction during the rotating and propagating motion of the mass; and mechanically separating the heaviest particles of the propagating mass from the mass flow.

9. The sorting method as defined in claim 8, wherein suction is used at least in two phases during the rotating and propagating movement of the mass.

10. The sorting method as defined in claim 8, wherein the amount of the mass to be mechanically separated is adjusted based on the structure of the mass.

11. The sorting method as defined in claim 8, wherein the method is repeated at least once for the mass that was left from the first sorting phase, from which mass, the lightest and the heaviest mass was removed.

12. The sorting method as defined in claim 8, wherein the method is implemented as two or more parallel and identical sorting processes, the unseparated masses obtained from which are combined and directed to a second similar sorting process.

13. The sorting device as defined in claim 1, wherein the granulated mass containing varied materials comprises granulated electronic scrap.

14. The sorting method as defined in claim 8, wherein the granulated mass containing varied materials comprises granulated electronic scrap.

* * * * *